US006464846B1

(12) United States Patent
Titterington

(10) Patent No.: US 6,464,846 B1
(45) Date of Patent: Oct. 15, 2002

(54) ELECTRICALLY-CONDUCTIVE ELASTOMERIC COMPRESSION PAD FOR USE WITH PROTON EXCHANGE MEMBRANE ELECTROCHEMICAL CELLS

(75) Inventor: William A. Titterington, River Ranch, FL (US)

(73) Assignee: Giner Electrochemical Systems, LLC, Newton, MA (US)

( * ) Notice: Subject to any disclaimer, the term of this patent is extended or adjusted under 35 U.S.C. 154(b) by 1 day.

(21) Appl. No.: 09/747,423

(22) Filed: Dec. 21, 2000

(51) Int. Cl.[7] ..... C25B 9/00

(52) U.S. Cl. ..... 204/267; 204/268; 204/286.1; 204/278.5; 204/252; 204/253; 204/254

(58) Field of Search ..... 204/267, 268, 204/286.1, 278.5, 252, 253, 254

(56) References Cited

U.S. PATENT DOCUMENTS

| | | | | |
|---|---|---|---|---|
| 4,137,144 A | * | 1/1979 | Kenney | 204/268 |
| 5,009,968 A | | 4/1991 | Guthrie et al. | 429/26 |
| 5,316,644 A | | 5/1994 | Titterington et al. | 204/284 |
| 5,324,565 A | | 6/1994 | Leonida et al. | 428/131 |
| 5,350,496 A | | 9/1994 | Smith et al. | 204/129 |
| 5,366,823 A | | 11/1994 | Leonida et al. | 429/34 |
| 5,466,354 A | | 11/1995 | Leonida et al. | 204/252 |
| 6,010,317 A | * | 1/2000 | Maget et al. | 204/283 |
| 6,037,075 A | * | 3/2000 | Critz et al. | 204/265 |
| 6,057,053 A | | 5/2000 | Gibb | 429/37 |
| 6,153,083 A | * | 11/2000 | Hofmann et al. | 204/267 |

* cited by examiner

*Primary Examiner*—Bruce F. Bell
(74) *Attorney, Agent, or Firm*—Kriegsman & Kriegsman

(57) ABSTRACT

Electrically-conductive compression pad suitable for use in an electrolysis cell stack. In a preferred embodiment, the electrically-conductive compression pad comprises a single sheet of electrically-conductive material, such as a metal. The electrically-conductive sheet has a top surface and a bottom surface and is bent upwardly and downwardly in a step-wise fashion to form an alternating pattern of parallel ribs and channels, the alternating pattern extending across the entirety of the sheet and being reversed on the bottom surface of the sheet. The pad also comprises a plurality of elastomeric strips, each strip being positioned within a corresponding channel and being secured to the sheet by an adhesive. The strips are preferably dimensioned and made of an appropriately compressible material so that, when the pad is compressed, the strips expand laterally to fill their respective channels and lie flush with their adjacent ribs.

25 Claims, 7 Drawing Sheets

ELECTRICALLY-CONDUCTIVE ELASTOMERIC COMPRESSION PAD FOR USE WITH PROTON EXCHANGE MEMBRANE ELECTROCHEMICAL CELLS

BACKGROUND OF THE INVENTION

The present invention relates generally to electrolysis cells (also referred to as electrolytic cells) and relates more particularly to electrically-conductive compression pads used in stacks of proton exchange membrane (PEM) electrolysis cells.

In certain controlled environments, such as those found in airplanes, submarines and spacecrafts, it is often necessary for oxygen to be furnished in order to provide a habitable environment. An electrolysis cell, which uses electricity to convert water to hydrogen and oxygen, represents one type of device capable of producing quantities of oxygen. One common type of electrolysis cell comprises a proton exchange membrane, an anode positioned along one face of the proton exchange membrane, and a cathode positioned along the other face of the proton exchange membrane. To enhance electrolysis, a catalyst, such as platinum, is typically present both at the interface between the anode and the proton exchange membrane and at the interface between the cathode and the proton exchange membrane. The above-described combination of a proton exchange membrane, an anode, a cathode and associated catalysts is commonly referred to in the art as a membrane electrode assembly.

In use, water is delivered to the anode and an electric potential is applied across the two electrodes, thereby causing the electrolyzed water molecules to be converted into protons, electrons and oxygen atoms. The protons migrate through the proton exchange membrane and are reduced at the cathode to form molecular hydrogen. The oxygen atoms do not traverse the proton exchange membrane and, instead, form molecular oxygen at the anode.

Often, a number of electrolysis cells are assembled together in order to meet hydrogen or oxygen production requirements. One common type of assembly is a stack comprising a plurality of stacked electrolysis cells that are electrically connected in series in a bipolar configuration. In a typical stack, each cell includes, in addition to a membrane electrode assembly of the type described above, a pair of multi-layer screens, one of said screens being in contact with the outer face of the anode and the other of said screens being in contact with the outer face of the cathode. The screens are used to form the fluid cavities within a cell for the water, hydrogen and oxygen. Each cell additionally includes a pair of polysulfone cell frames, each cell frame peripherally surrounding a screen. The frames are used to peripherally contain the fluids and to conduct the fluids into and out of the screen cavities. Each cell further includes a pair of metal foil separators, one of said separators being positioned against the outer face of the anode screen and the other of said separators being positioned against the outer face of the cathode screen. The separators serve to axially contain the fluids on the active areas of the cell assembly. In addition, the separators and screens together serve to conduct electricity from the anode of one cell to the cathode of its adjacent cell. Plastic gaskets seal the outer faces of the cell frames to the metal separators, the inner faces of the cell frames being sealed to the proton exchange membrane. The cells of the stack are typically compressed between a spring-loaded rigid top end plate and a bottom base plate.

Patents and publications relating to electrolysis cell stacks include the following, all of which are incorporated herein by reference: U.S. Pat. No. 6,057,053, inventor Gibb, issued May 2, 2000; U.S. Pat. No. 5,350,496, inventors Smith et al., issued Sep. 27, 1994; U.S. Pat. No. 5,316,644, inventors Titterington et al., issued May 31, 1994; U.S. Pat. No. 5,009,968, inventors Guthrie et al., issued Apr. 23, 1991; and Coker et al., "Industrial and Government Applications of SPE Fuel Cell and Electrolyzers," presented at The Case Western Symposium on "Membranes and Ionic and Electronic Conducting Polymer," May 17–19, 1982 (Cleveland, Ohio).

In order to ensure optimal conversion of water to hydrogen and oxygen by each electrolysis cell in a stack, there must be uniform current distribution across the active areas of the electrodes of each cell. Such uniform current distribution requires uniform contact pressure over the active areas of the electrodes. However, uniform contact pressure over the active areas is seldom attained solely through design since the dimensions of the various components of a cell typically vary within some specified limits due to the production methods used in their fabrication. In fact, standard electrolysis cells often show compounded component dimensional variations of about 0.007 to about 0.010 inch due to fabrication limitations, with additional dimensional variations of up to about 0.002 inch due to differential thermal expansion during electrolysis cell operation.

One approach to the aforementioned problem of maintaining uniform contact pressure over the entire active areas of the electrodes has been to provide an electrically-conductive compression pad between adjacent cells in a stack. One type of electrically-conductive compression pad that has received widespread use in the art comprises an elastic disk, said disk being provided with an array of transverse holes and transverse slots. The transverse holes are provided in the disk to allow for lateral expansion during compression of the disk. The transverse slots are provided in the disk so that a plurality of parallel metal strips may be woven from one face of the disk to the opposite face of the disk through the slots.

Other types of electrically-conductive compression pads are disclosed in the following patents, all of which are incorporated herein by reference: U.S. Pat. No. 5,466,354, inventors Leonida et al., issued Nov. 14, 1995; U.S. Pat. No. 5,366,823, inventors Leonida et al., issued Nov. 22, 1994; and U.S. Pat. No. 5,324,565, inventors Leonida et al., issued Jun. 28, 1994.

Compression pads of the type described above comprising an elastic disk having parallel metal strips woven therethroughout are generally capable of compensating for dimensional variations of a cell to maintain uniform contact over the active areas of the cell up to pressures of about 500 psi. Unfortunately, however, more and more applications require increased gas delivery pressure capabilities. Increased pressure requirements were initially addressed by enclosing the entire cell stack within a pressure vessel to limit the maximum load across the pressure pad to about 200 psi. In such a configuration, the compression pad was vented to the vessel, and the stack was operated in a balanced pressure mode, i.e., both gases were produced at approximately the same pressure. The vessel plus the pressure controls associated with this configuration, however, added significant weight and expense to the system.

Electrolysis cell stacks without a pressure vessel are simpler, lighter, and less expensive than those requiring pressure vessels. In such a configuration omitting a pressure vessel, the compression pad is totally sealed, i.e., not externally vented, and must withstand significantly higher pressure differentials, approximately equal to the sum of the highest internal pressure during operation and the compression required to maintain uniform contact. This pressure differential can reach about 2,500 psi or greater. As can readily be appreciated, such pressure differentials render compression pads of the type described above only marginally useful.

SUMMARY OF THE INVENTION

It is an object of the present invention to provide a novel electrically-conductive compression pad suitable for use in an electrolysis cell stack.

It is another object of the present invention to provide an electrically-conductive compression pad of the type described above that overcomes at least some of the shortcomings discussed above in connection with existing electrically-conductive compression pads.

It is still another object of the present invention to provide an electrically-conductive compression pad of the type described above that can be mass-produced, that is easy to manufacture and that is simple to use.

Therefore, in furtherance of the above and other objects to be described or to become apparent from the description below, there is provided herein an electrically-conductive compression pad suitable for use in an electrolysis cell stack, said electrically-conductive compression pad being constructed according to the teachings of the present invention and comprising (a) a single sheet of electrically-conductive material, said single sheet of electrically-conductive material having a top surface and a bottom surface; and (b) elastomeric material arranged on said single sheet of electrically-conductive material in such a way that, when said elastomeric material is compressed, substantially uniform pressure is exerted across each of said top surface and said bottom surface of said single sheet.

With respect to the aforementioned compression pad, the elastomeric material is preferably arranged on each of said top and bottom surfaces of said single sheet, and said single sheet is preferably bent to lie flush with said elastomeric material at one or more points on each of said top and bottom surfaces when said elastomeric material is compressed. Said single sheet of electrically-conductive material is preferably a sheet of metal, said metal preferably being, but not being limited to, a low resistivity (or high conductivity) metal selected from the group consisting of niobium, titanium, zirconium, tantalum, copper, nickel, hastelloy, and steel. Said single sheet may be circular or rectangular in shape but is not limited thereto. The elastomeric material is preferably a rubber having a shore A durometer of approximately 45 to 100. For example, where the compression pad is intended for use at pressures of up to about 800 psi. the elastomeric material may be a silicone rubber having a shore A durometer of about 55; alternatively,. where the compression pad is intended for use at pressures of up to about 2500 psi, the elastomeric material may be a polyurethane having a shore A durometer of about 95.

According to another aspect of the invention, there is provided an electrically-conductive compression pad suitable for use in an electrolysis cell stack, said electrically-conductive compression pad comprising (a) a single sheet of electrically-conductive material, said single sheet of electrically-conductive material having a top surface and a bottom surface, said single sheet of electrically-conductive material being bent up and down to include a plurality of alternating ribs and channels; and (b) elastomeric material mounted within said channels, said elastomeric material being dimensioned so that, when said elastomeric material is compressed, said elastomeric material lies flush with said ribs and exerts substantially uniform pressure across each of said top surface and said bottom surface of said single sheet.

With respect to the aforementioned compression pad, the alternating ribs and channels are preferably linear and parallel to one another. The ribs on the top surface of said single sheet form channels on the bottom surface of said single sheet and vice versa. Said single sheet is preferably a sheet of metal, said metal preferably being, but not being limited to, a low resistivity (or high conductivity) metal selected from the group consisting of niobium, titanium, zirconium, tantalum, copper, nickel, hastelloy and steel. Said single sheet may be circular or rectangular in shape but is not limited in shape thereto. The elastomeric material is preferably a rubber having a shore A durometer of approximately 45 to 100. For example, where the compression pad is intended for use at pressures of up to about 800 psi, the elastomeric material may be a silicone rubber having a shore A durometer of about 55; alternatively, where the compression pad is intended for use at pressures of up to about 2500 psi, the elastomeric material may be a polyurethane having a shore A durometer of about 95.

According to still another aspect of the present invention, there is provided an electrolysis cell stack, said electrolysis cell stack comprising (a) a first electrolysis cell; (b) a second electrolysis cell, said second electrolysis cell being arranged in series with said first electrolysis cell; and (c) an electrically-conductive compression pad of the type described above interposed between said first electrolysis cell and said second electrolysis cell.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
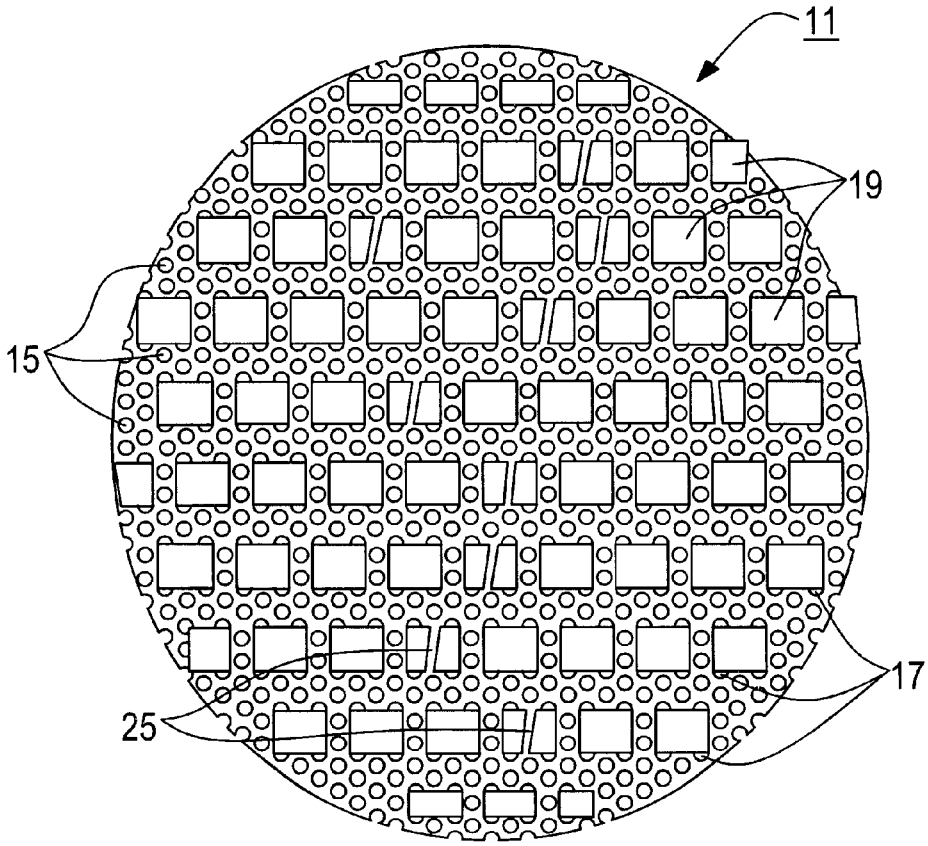
FIG. 1 PRIOR ART
FIG. 1 is a top view of a conventional electrically-conductive compression pad suitable for use in an electrolysis cell stack.
Figure 2:
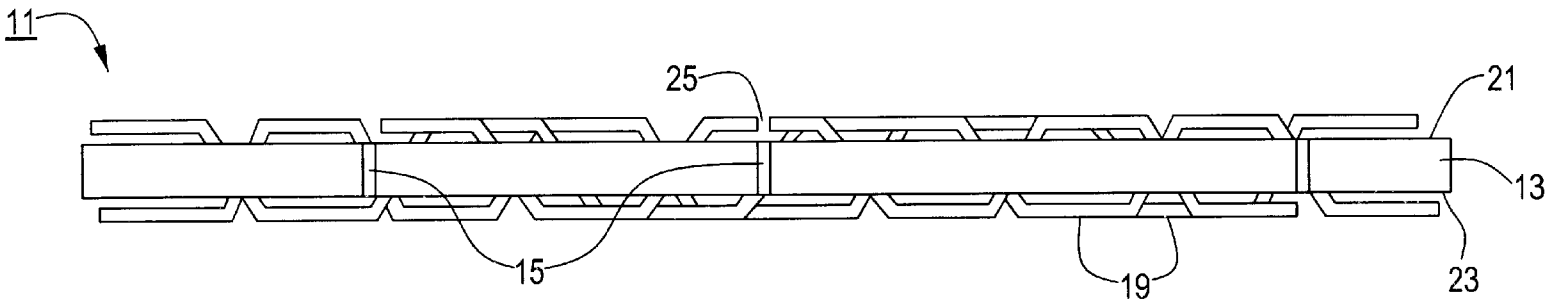
FIG. 2 PRIOR ART
FIG. 2 is a front end view of the compression pad of FIG. 1.

Referring now to FIGS. 1 and 2, there are shown top and front end views, respectively, of a conventional electrically-conductive compression pad suitable for use in an electrolysis cell stack, said conventional electrically-conductive compression pad being represented generally by reference numeral 11.

Figure 3:
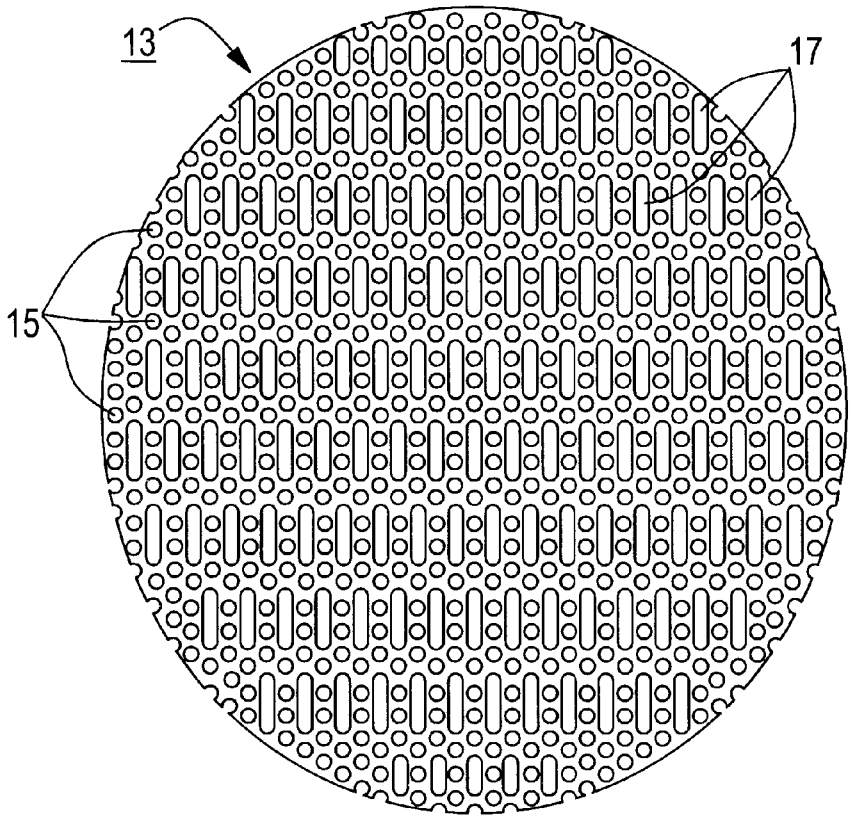
FIG. 3 PRIOR ART
FIG. 3 is a top view of the elastic disk of the compression pad of FIG. 1.

Pad 11 comprises a disk 13. Disk 13 is typically made of a silicone rubber and has a thickness of about 0.065 inch. As seen best in FIG. 3, disk 13 is provided with a patterned array of transverse holes 15 and transverse slots 17. Holes 15 allow for lateral expansion of disk 13 when disk 13 is compressed so that the overall surface area of disk 13 does not increase significantly during compression. The function of slots 17 is apparent from the description below.

Referring back to FIGS. 1 and 2, pad 11 comprises a plurality of metal strips 19. Strips 19, which typically have a thickness of about 0.005 inch are woven in a parallel arrangement from the top face 21 of disk 13 to the bottom face 23 of disk 13 through slots 17. Strips 19 are typically provided with transverse breaks 25 to allow for expansion.

Figure 4:
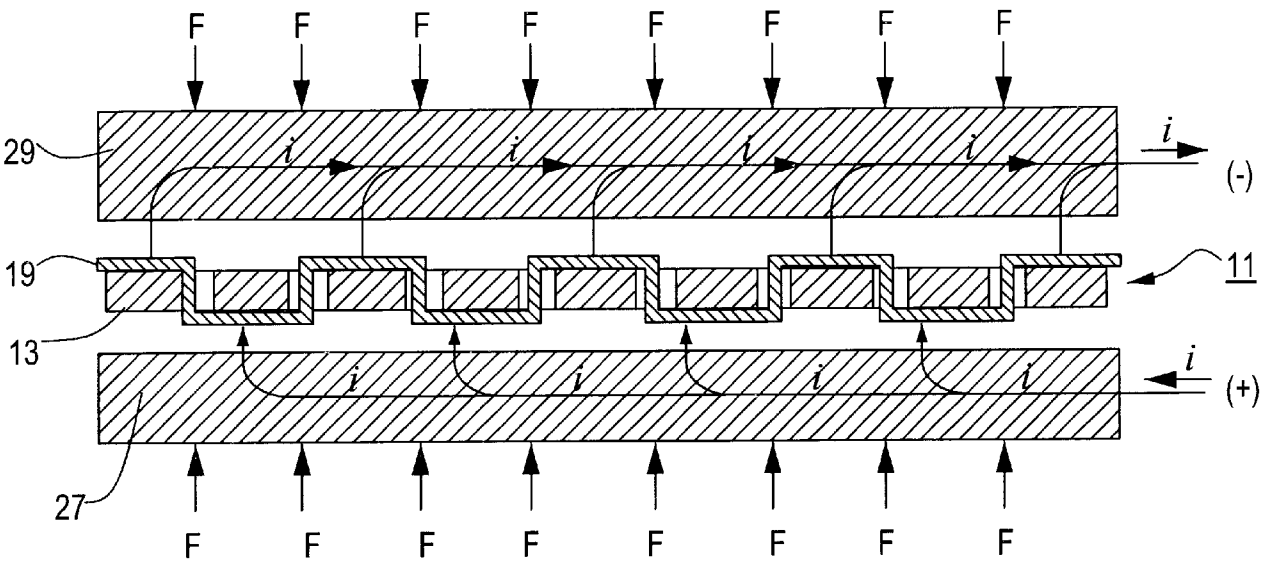
FIG. 4 PRIOR ART
FIG. 4 is a schematic section view of the compression pad of FIG. 1 positioned between the metal separators of two adjacent cells of an electrolysis cell stack.

Referring now to FIG. 4, there is shown a schematic section view of compression pad 11 positioned between the metal separators 27 and 29 of adjacent cells within an electrolysis cell stack. As can be seen, disk 13 serves to evenly distribute the pressure exerted by the clamping force over the entireties of separators 27 and 29. At the same time, strip 19 serves to electrically interconnect separators 27 and 29 at a plurality of points along the length of strip 19.

Unfortunately, however, as described above, compression pad 11 has marginal utility when used in electrolysis cell stacks in which the differential pressure exceeds about 500 psi.

Figure 5:
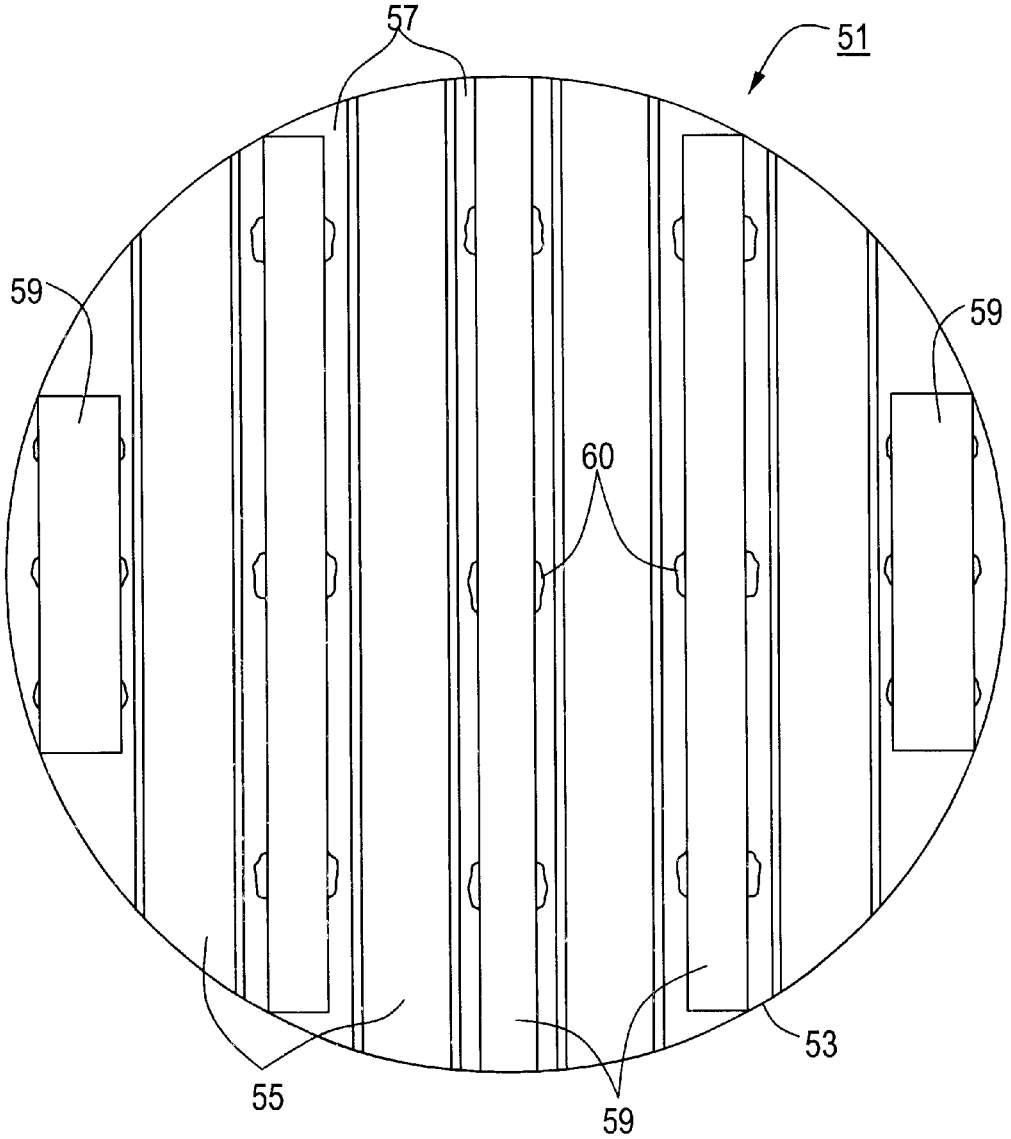
FIG. 5 is a top view of a first embodiment of an electrically-conductive compression pad constructed according to the teachings of the present invention.
Figure 6:
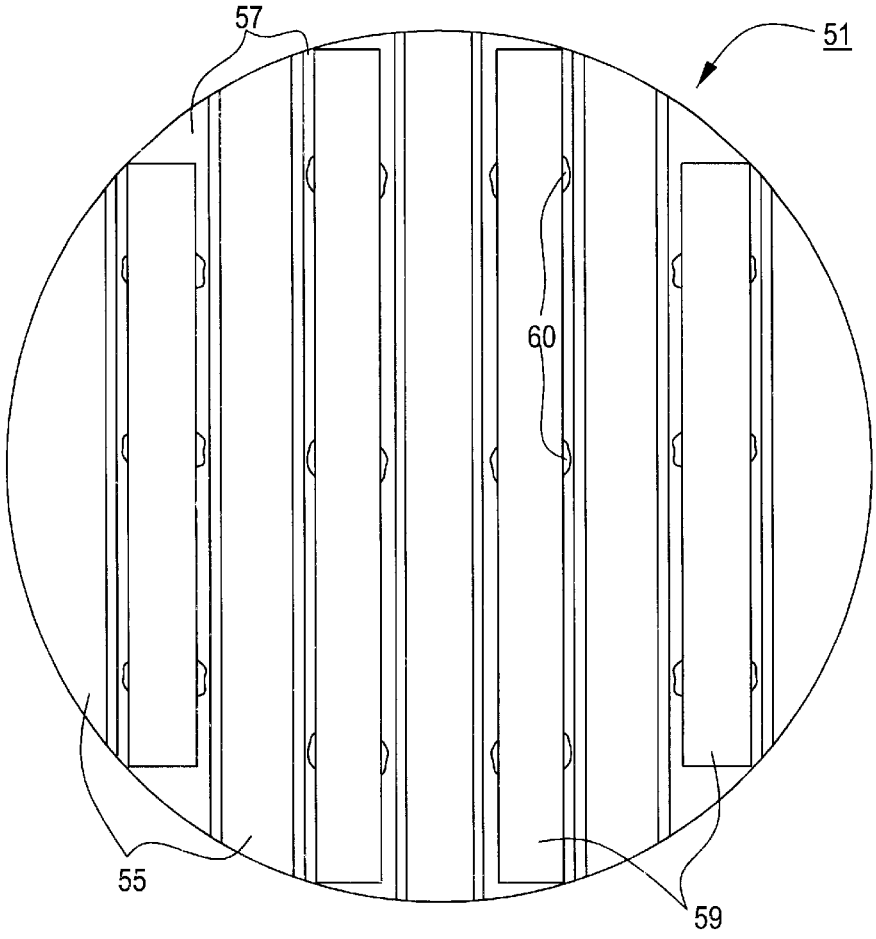
FIG. 6 is a bottom view of the electrically-conductive compression pad of FIG. 5.
Figure 7:
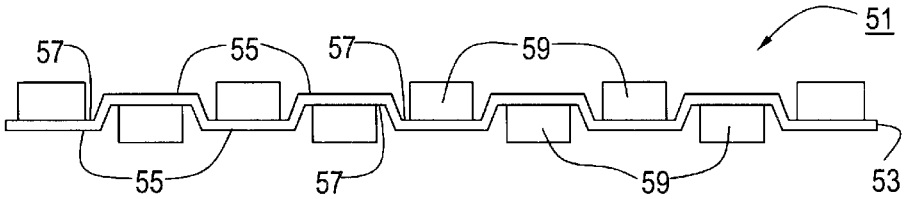
FIG. 7 is a front end view of the electrically-conductive compression pad of FIG. 5.

Referring now to FIGS. 5 through 7, there are shown top, bottom and front end views, respectively, of a first embodiment of an electrically-conductive compression pad constructed according to the teachings of the present invention, said electrically-conductive compression pad being represented generally by reference numeral 51.

Pad 51 comprises an electrically-conductive disk 53. Disk 53 is preferably made from a single sheet of metal. Examples of suitable metals for use as disk 53 are low resistivity (or high conductivity) metals including, but not limited to, niobium, titanium, zirconium, tantalum, copper, nickel, hastelloy, and steel. Of the foregoing metals, niobium is preferred. Disk 53 preferably has a thickness of approximately 0.005 inch.

Preferably, disk 53 is shaped (e.g., by bending, folding, stamping, etc.) to include an alternating pattern of parallel ribs 55 and channels 57, said alternating pattern extending across the entirety of disk 53 and being reversed on the opposite face of disk 53.

Figure 8:
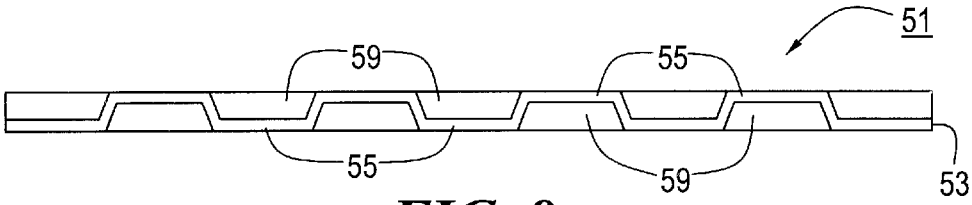
FIG. 8 is a front end view of the electrically-conductive compression pad of FIG. 5, showing the pad in a fully compressed state.

Pad 51 also comprises a plurality of elastomeric strips 59, each strip 59 being positioned within a corresponding channel 57 and being secured to disk 53 by an adhesive 60. Strips 59 are preferably dimensioned and made of an appropriately compressible material so that, when pad 51 is compressed, strips 59 expand laterally to fill their respective channels 57 and lie flush with their adjacent ribs 55. In this manner, strips 59 form an essentially uninterrupted, flat surface on alternating sides of disk 53 (see FIG. 8), thereby allowing uniform pressure over its entire surface area to be applied to a pair of electrolysis cells positioned on opposite sides thereof while, at the same time, electrically interconnecting said pair of electrolysis cells.

The elastomeric material used to make strips 59 is preferably selected based on the operating conditions of the cell stack. These operating conditions may include pressure and temperature, as well as the thickness and deformation of the compression pad during use. Since compression pad 51 and, in particular, strips 59 compensate for component dimensional variations, the elastomeric material must be sufficiently compressible so that the size of the compressed elastomeric material substantially coincides with the component dimensional variation within the cell. The compressibility range of strips 59 is dependent upon its hardness. If the elastomeric material has a shore A durometer hardness greater than about 100, it is basically solid and incompressible and therefore not capable of compensating for the component dimensional variations. In contrast, if the elastomeric material has a shore A durometer hardness less than about 45, it is soft and incapable of maintaining uniform contact pressure. Therefore, elastomeric material including rubbers, such as silicone rubber, fluorosilicon rubber, nitrile rubber, and polyurethane, and other materials having a shore A durometer hardness of about 45 to 100 are suitable elastomeric materials for use as strips 59. Silicone rubber, which has a shore A durometer hardness of about 55, is most suitable where pressures of up to 800 psi are likely to be experienced whereas polyurethane, which has a shore A durometer hardness of about 95, is suitable where higher pressures of up to about 2500 psi are likely to be experienced. As can readily be appreciated, by varying the type of elastomeric material used to make strips 59, one can adjust the amount of pressure exerted by strips 59.

In an illustrative example of pad 51, disk 53 is made of niobium and has a diameter of approximately 6.1 inch and a thickness of approximately 0.005 inch. Five ribs 55 and four channels 57 are present on the top surface of disk 53, and five channels 57 and four ribs 55 are present on the bottom surface of disk 53. Each channel 57 has a width that is approximately $^{23}/_{32}$ inch. Strips 59 are made of silicone rubber having a shore A durometer hardness of approximately 55, each strip 59 having a width of approximately $^{15}/_{32}$ inch and a thickness of approximately $^{1}/_{16}$ inch.

Some additional features and/or advantages of pad 51 are as follows: (1) It reduces the need for re-tightening or cleaning for periodic maintenance of contact pressure to maintain the selected level of electrical conductivity; (2) It minimizes distortion (i.e., dents, etc.) of the mating parts of the stack in contact with the pad since contact with the pad is over a wide surface area; (3) Proper selection of the materials used to make the pad to withstand deterioration is available over a wide range of environmental conditions; (4) Constant contact pressure can be maintained over a number of individual parts in a stacked series arrangement; and (5) Dimensional thickness variations between stacked parts within a sub-assembly can be accommodated to maintain the same pressure across the facing surface. This is especially desirable in a stack when the parts are rigid or machined within a tolerance, thus requiring a flexible pad to maintain full surface contact.

Figure 9:
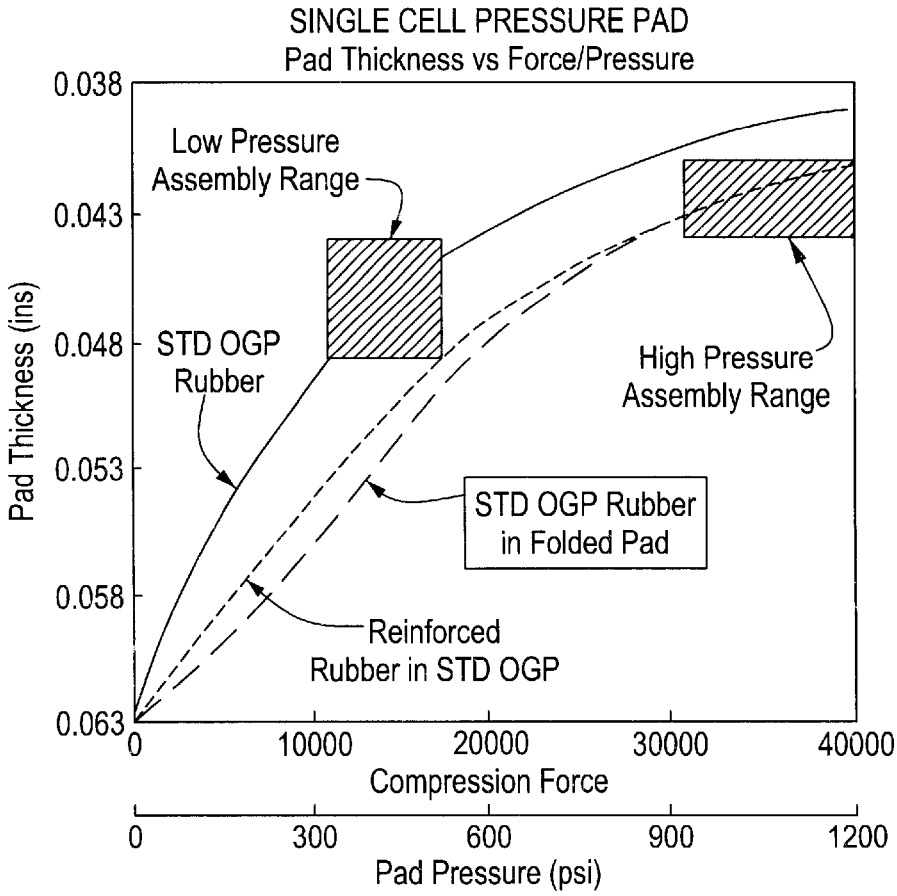
FIG. 9 is a graphic representation of the compression forces the compression pads of FIG. 1 and FIG. 5 are able to withstand.

Referring now to FIG. 9, there is shown a graphic representation of the relative compression forces compression pads 11 and 51 are able to withstand. As can be seen, compression pad 51 is able to withstand a considerably greater compression force than compression pad 11.

Figure 10:
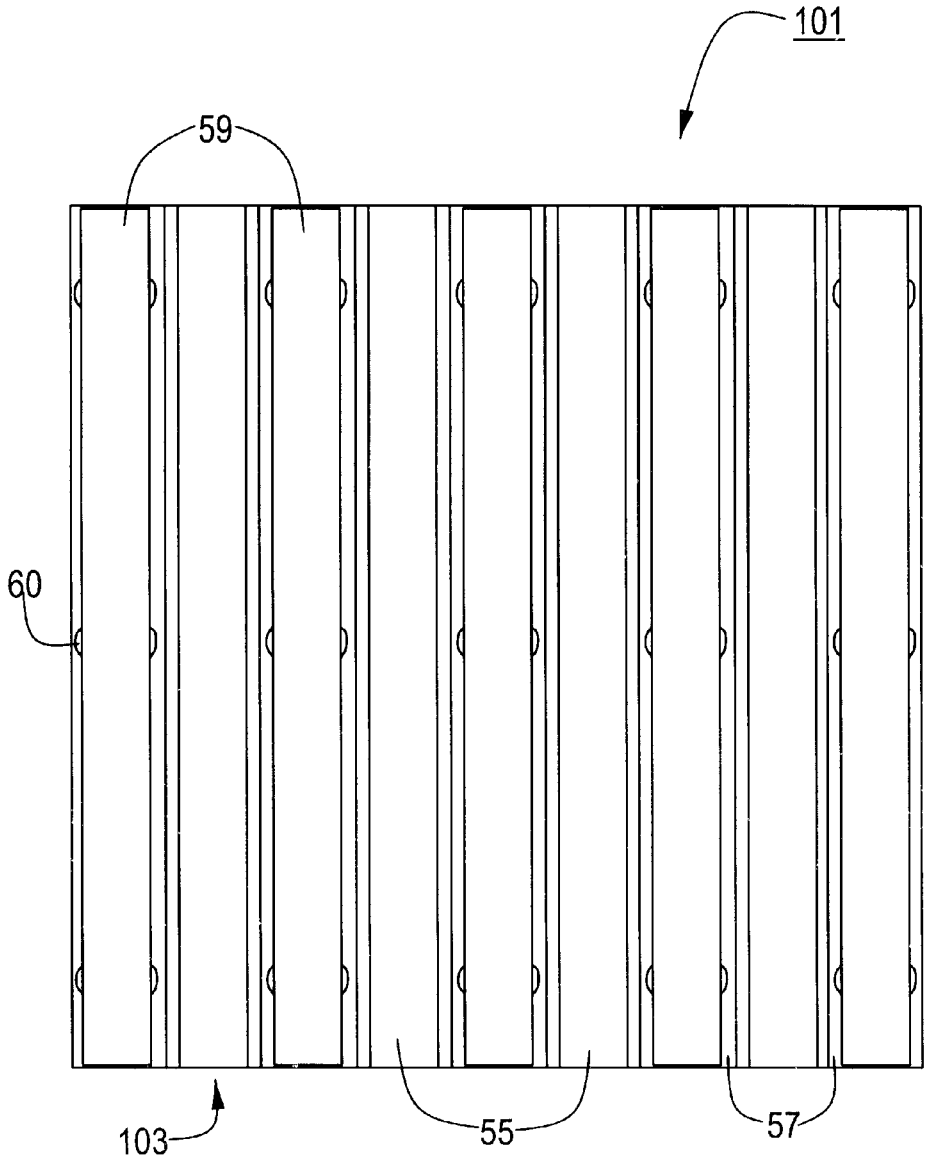
FIG. 10 is a top view of a second embodiment of an electrically-conductive compression pad constructed according to the teachings of the present invention.

Referring now to FIG. 10, there is shown a top view of a second embodiment of an electrically-conductive compression pad constructed according to the teachings of the present invention, said electrically-conductive compression pad being represented generally by reference numeral 101.

Pad 101 is similar in most respects to pad 51, the principal difference between the two pads being that pad 101 includes a rectangularly-shaped electrical conductor 103, instead of disk 53. Conductor 103 may be made of the same materials as disk 53.

It should be understood that, whereas the compression pad of the present invention has been described as being suitable for use in electrolysis cell stacks, said compression pad is equally suitable for use in fuel cell stacks. Accordingly, unless otherwise noted to the contrary, all references in the present specification and claims to electrolysis cell stacks are intended to encompass fuel cell stacks as well.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An electrically-conductive compression pad suitable for use in an electrolysis cell stack, said electrically-conductive compression pad comprising:

(a) a single sheet of electrically-conductive material, said single sheet of electrically-conductive material having a top surface and a bottom surface; and (b) elastomeric material arranged on said single sheet of electrically-conductive material in such a way that, when said elastomeric material is compressed, substantially uniform pressure is exerted across each of said top surface and said bottom surface of said single sheet.

2. The electrically-conductive compression pad as claimed in claim 1 wherein said elastomeric material is arranged on each of said top and bottom surfaces of said single sheet and wherein said single sheet of electrically-conductive material is bent to lie flush with said elastomeric material at one or more points on each of said top and bottom surfaces when said elastomeric material is compressed.

3. The electrically-conductive compression pad as claimed in claim 2 wherein said single sheet of electrically-conductive material is a sheet of metal.

4. The electrically-conductive compression pad as claimed in claim 3 wherein said metal is selected from the group consisting of niobium, titanium, zirconium, tantalum, copper, nickel, steel, and hastelloys.

5. The electrically-conductive compression pad as claimed in claim 4 wherein said metal is niobium.

6. The electrically-conductive compression pad as claimed in claim 5 wherein said single sheet of electrically conductive material has a thickness of about 0.005 inch.

7. The electrically-conductive compression pad as claimed in claim 2 wherein said elastomeric material is a rubber having a shore A durometer of approximately 45 to 100.

8. The electrically-conductive compression pad as claimed in claim 7 wherein said rubber is a silicone rubber having a shore A durometer of about 55.

9. The electrically-conductive compression pad as claimed in claim 2 wherein said elastomeric material is a polyurethane having a shore A durometer of about 95.

10. The electrically-conductive compression pad as claimed in claim 2 wherein said single sheet of electrically-conductive material is circular in shape.

11. The electrically-conductive compression pad as claimed in claim 2 wherein said single sheet of electrically-conductive material is rectangular in shape.

12. An electrolysis cell stack comprising:

(a) a first electrolysis cell;

(b) a second electrolysis cell, said second electrolysis cell being arranged in series with said first electrolysis cell; and (c) the electrically-conductive compression pad of claim 2 interposed between said first electrolysis cell and said second electrolysis cell.

13. An electrolysis cell stack comprising:

(a) a first electrolysis cell;

(b) a second electrolysis cell, said second electrolysis cell being arranged in series with said first electrolysis cell; and (c) the electrically-conductive compression pad of claim 1 interposed between said first electrolysis cell and said second electrolysis cell.

14. An electrically-conductive compression pad suitable for use in an electrolysis cell stack, said electrically-conductive compression pad comprising:

(a) a single sheet of electrically-conductive material, said single sheet of electrically-conductive material having a top surface and a bottom surface, said single sheet of electrically-conductive material being bent up and down to include a plurality of alternating ribs and channels; and (b) elastomeric material mounted within said channels, said elastomeric material being dimensioned so that, when said elastomeric material is compressed, said elastomeric material lies flush with said ribs and exerts substantially uniform pressure across each of said top surface and said bottom surface of said single sheet.

15. The electrically-conductive compression pad as claimed in claim 14 wherein said alternating ribs and channels are linear and parallel to one another.

16. The electrically-conductive compression pad as claimed in claim 14 wherein said single sheet of electrically-conductive material is a sheet of metal.

17. The electrically-conductive compression pad as claimed in claim 16 wherein said metal is selected from the group consisting of niobium, titanium, zirconium, tantalum, copper, nickel, steel and hastelloys.

18. The electrically-conductive compression pad as claimed in claim 17 wherein said metal is niobium.

19. The electrically-conductive compression pad as claimed in claim 18 wherein said single sheet of electrically conductive material has a thickness of about 0.005 inch.

20. The electrically-conductive compression pad as claimed in claim 14 wherein said elastomeric material is a rubber having a shore A durometer of approximately 45 to 100.

21. The electrically-conductive compression pad as claimed in claim 20 wherein said rubber is a silicone rubber having a shore A durometer of about 55.

22. The electrically-conductive compression pad as claimed in claim 14 wherein said elastomeric material is a polyurethane having a shore A durometer of about 95.

23. The electrically-conductive compression pad as claimed in claim 14 wherein said single sheet of electrically-conductive material is circular in shape.

24. The electrically-conductive compression pad as claimed in claim 14 wherein said single sheet of electrically-conductive material is rectangular in shape.

25. An electrolysis cell stack comprising:

(a) a first electrolysis cell;

(b) a second electrolysis cell, said second electrolysis cell being arranged in series with said first electrolysis cell; and (c) the electrically-conductive compression pad of claim 14 interposed between said first electrolysis cell and said second electrolysis cell.

* * * * *